US008839863B2

(12) United States Patent
Hetz et al.

(10) Patent No.: US 8,839,863 B2
(45) Date of Patent: Sep. 23, 2014

(54) HIGH PRESSURE/DEEP WATER PERFORATING SYSTEM

(75) Inventors: Avigdor Hetz, Houston, TX (US); Randy L. Evans, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 433 days.

(21) Appl. No.: 12/773,675

(22) Filed: May 4, 2010

(65) Prior Publication Data

US 2010/0276144 A1 Nov. 4, 2010

Related U.S. Application Data

(60) Provisional application No. 61/175,355, filed on May 4, 2009.

(51) Int. Cl.
*E21B 43/116* (2006.01)
*E21B 29/02* (2006.01)

(52) U.S. Cl.
CPC ..... *E21B 43/116* (2013.01)
USPC ..... 166/297; 166/55

(58) Field of Classification Search
CPC ... E21B 43/116; E21B 43/117; E21B 43/119; E21B 43/114; E21B 43/11; E21B 43/11857; E21B 29/02; E21B 43/263
USPC ..... 166/297, 298, 55, 63, 55.1
See application file for complete search history.

(56) References Cited

U.S. PATENT DOCUMENTS 3,773,119 A * 11/1973 Shore ..... 175/4.6
4,071,096 A * 1/1978 Dines ..... 175/4.6
4,081,031 A * 3/1978 Mohaupt ..... 166/299
4,139,676 A * 2/1979 Janssen et al. ..... 428/402
4,583,602 A 4/1986 Ayers
4,662,450 A * 5/1987 Haugen ..... 166/299
4,823,875 A * 4/1989 Hill ..... 166/280.1
5,074,366 A * 12/1991 Karlsson et al. ..... 175/76
5,366,013 A * 11/1994 Edwards et al. ..... 166/297
5,964,294 A * 10/1999 Edwards et al. ..... 166/297
6,119,771 A * 9/2000 Gano et al. ..... 166/50
6,520,258 B1 * 2/2003 Yang et al. ..... 166/297
6,679,327 B2 * 1/2004 Sloan et al. ..... 166/297
7,044,236 B2 5/2006 Iversen et al.
7,451,819 B2 * 11/2008 Chang et al. ..... 166/299
7,610,969 B2 * 11/2009 LaGrange et al. ..... 175/4.6
7,828,051 B2 * 11/2010 Walker ..... 166/55.1
7,845,410 B2 * 12/2010 Chang et al. ..... 166/297
7,984,761 B2 * 7/2011 Chang et al. ..... 166/297
2001/0018977 A1 * 9/2001 Kilgore ..... 166/387
2002/0100586 A1 8/2002 Ross et al.
2003/0089498 A1 * 5/2003 Johnson et al. ..... 166/297
2006/0070738 A1 4/2006 Sloan et al.
2006/0070739 A1 * 4/2006 Brooks et al. ..... 166/299
2008/0264639 A1 * 10/2008 Parrott et al. ..... 166/297
2009/0032258 A1 * 2/2009 Chang et al. ..... 166/299
2009/0044949 A1 * 2/2009 King et al. ..... 166/332.4
2010/0038076 A1 * 2/2010 Spray et al. ..... 166/207
2010/0276136 A1 * 11/2010 Evans et al. ..... 166/55.2

OTHER PUBLICATIONS

International Preliminary Report on Patentability for PCT/US2010/033901, dated Nov. 9, 2011, 5 pages.
International Search Report and Written Opinion for PCT/US 2010/033901, dated May 6, 2010, 9 pages.

* cited by examiner

*Primary Examiner* — Shane Bomar
*Assistant Examiner* — Wei Wang
(74) *Attorney, Agent, or Firm* — Bracewell & Giuliani LLP

(57) ABSTRACT

A perforating system having a perforating gun with a gun body formed from a ductile material. The gun body deforms under pressure while maintaining sufficient structural integrity to remain intact and without rupturing or leaking. A flowable material can be inserted within the gun body that provides additional support to the gun body.

13 Claims, 2 Drawing Sheets

HIGH PRESSURE/DEEP WATER PERFORATING SYSTEM

CROSS REFERENCE TO RELATED APPLICATIONS

This application claims priority to and the benefit of U.S. Provisional Application Ser. No. 61/175,355, filed May 4, 2009, the full disclosure of which is hereby incorporated by reference herein.

BACKGROUND

1. Field of Invention

The invention relates generally to the field of oil and gas production. More specifically, the present invention relates to a perforating system adapted to withstand high wellbore pressure.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 4 is shown. For the sake of clarity, the system 4 depicted comprises a single perforating gun 6 instead of a multitude of guns. The gun 6 is shown disposed within a wellbore 1 on a wireline 5. The perforating system 4 as shown also includes a service truck 7 on the surface 9, where in addition to providing a raising and lowering means, the wireline 5 also provides communication and control connectivity between the truck 7 and the perforating gun 6. The wireline 5 is threaded through pulleys 3 supported above the wellbore 1. As is known, derricks, slips and other similar systems may be used in lieu of a surface truck for inserting and retrieving the perforating system into and from a wellbore. Moreover, perforating systems may also be disposed into a wellbore via tubing, drill pipe, slick line, coiled tubing, to mention a few.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

With reference to FIG. 2 to a side partial sectional view of a perforating gun 6 is shown. The perforating gun 6 an annular gun tube 16 in which the shaped charges 8 are arranged in a phased pattern. The gun tube 16 is coaxially disposed within an annular gun body 14. On an end of the perforating gun 6 is an end cap 20 shown threadingly attached to the gun body 14. On the end of the perforating gun 6 opposite the end cap 20 is a lower sub 22 also threadingly attached to the gun body 14. The lower sub 22 includes a chamber shown having an electrical cord 24 attached to a detonator 26. As is known, an associated firing head (not shown) can emit an electrical signal that transferred through the wire and to the detonator 26 for igniting a detonating cord 28 that in turn detonates the shaped charge 8.

Provided between the gun body 14 and gun tube 16 is an annulus 18. The pressure in the annulus 18 is substantially at the atmospheric pressure where the perforating gun 6 is assembled—which is generally about 0 pounds per square inch gauge (psig). However, shaped charge 8 detonation often takes place deep within a well bore, where the ambient pressure can often exceed 5,000 psig. As such, a large pressure difference can exist across the gun body 14 wall thereby requiring an enhanced strength walls as well as rigorous sealing requirements in a perforating gun 6.

SUMMARY OF INVENTION

Disclosed herein is a perforating system having a perforating gun enhanced to withstand high pressure wellbores. In an embodiment, the perforating gun includes a shaped charge disposed in a ductile gun body that deforms around the shaped charges in response to external pressure. The deformed gun body is resilient to leakage or buckling. A flowable material can be inserted within the gun body to provide support for the body in resisting its collapse.

BRIEF DESCRIPTION OF DRAWINGS

Some of the features and benefits of the present invention having been stated, others will become apparent as the description proceeds when taken in conjunction with the accompanying drawings, in which.

Figure 1:
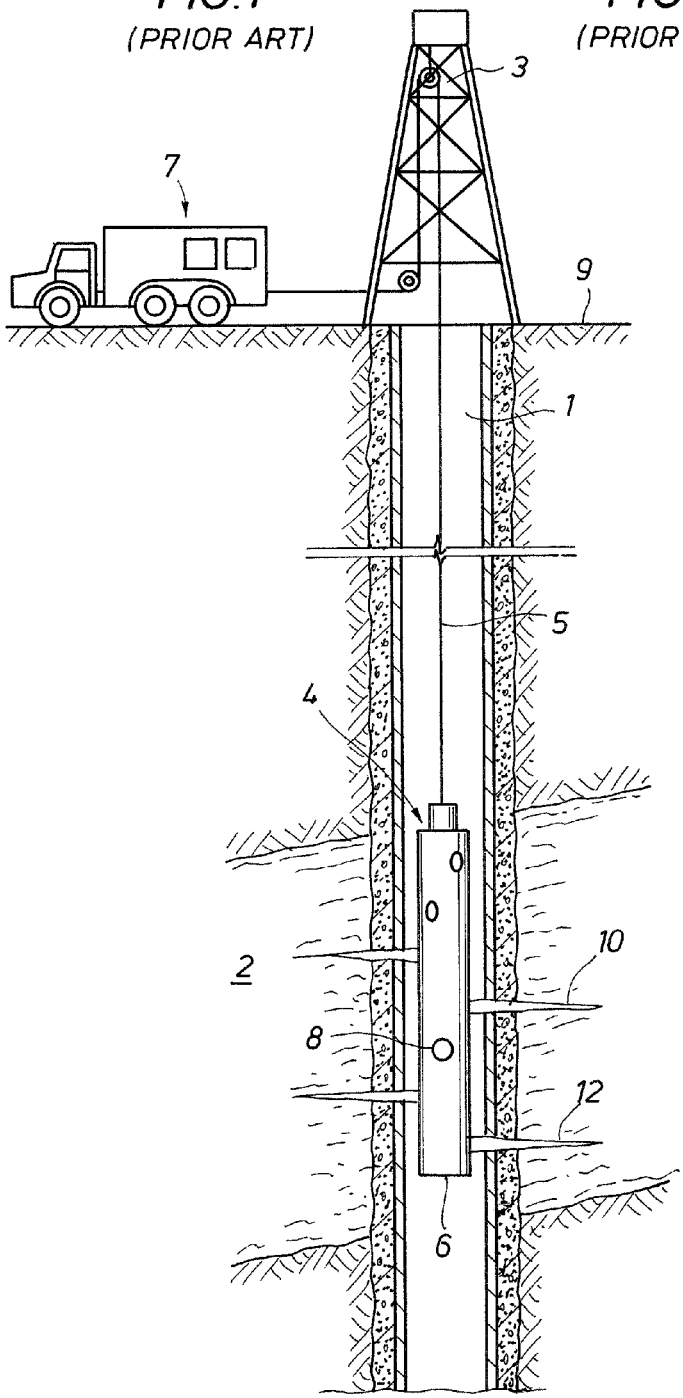
FIG.1 (PRIOR ART)
FIG. 1 is partial cutaway side view of a prior art perforating system in a wellbore.
Figure 2:
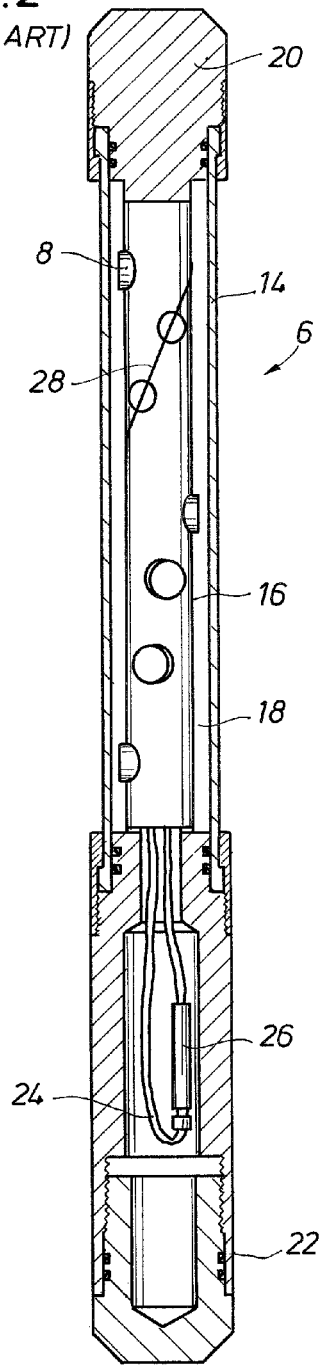
FIG.2 (PRIOR ART)
FIG. 2 illustrates a side sectional view of a prior art perforating gun.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Figure 3:
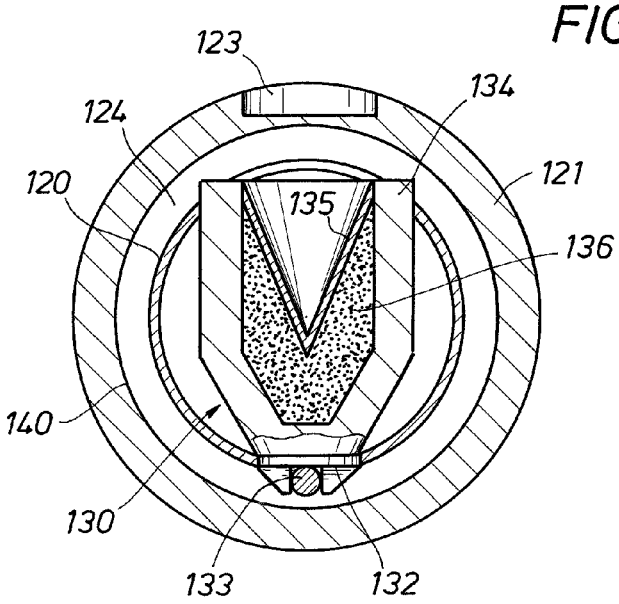
FIG. 3 depicts an axial sectional view of an embodiment of a perforating gun with a shaped charge in accordance with the present disclosure.

With reference now to FIG. 3, an example of a perforating gun 121 is shown in a side partial sectional view. In this embodiment, the perforating gun 121 includes an annular gun body 140 circumscribing an annular gun tube 120. An annular space 124 is defined between the gun tube 120 and gun body 140. Held within the gun tube 120 is a shaped charge 130. In the embodiment of FIG. 3, the shaped charge 130 includes a body or housing 134 having a closed lower end and an open upper end. The body 134 configuration is substantially tubular proximate the open end and transitions to a frusto-conical shape proximate the closed end. The walls of the housing 134 define a partial enclosure in which high explosive 136 is provided through the upper end followed by insertion of a conical liner 135 over the explosive 136. FIG. 3 further depicts a detonation cord 133 and cord attachment 132 on the shaped charge 130 lower end. A scallop 123 is shown in the gun body 140 provided where the metal jet from the shaped charge 130 discharges through the gun body 140.

In the embodiment of FIG. 3, the gun body 140 includes a material able to deform without rupturing. More specifically, the gun body 140 remains intact and functional when exposed to a high pressure environment. For example, when exposed to higher than typical wellbore pressure, the gun body 140 may bow inward in response to the wellbore pressure. The constituents of the material making up the gun body 140, impart properties to the gun body 140 so that the gun body 140 can deflect in response to an applied external pressure and yet not affect the shaped charge 130 or operation of the shaped charge 130. Example materials include aluminum, steel, stainless steel, nickel, tungsten, molybdenum, other ductile metals, and alloys and combinations thereof. Other example materials include composites, polymers, reinforced carbon, combinations thereof, and the like. The material making up the gun body 140 can have a high elasticity, such as up to 20% elongation. Other values of elongation include 3%, 5%, 10%, 15%, 20%, 25%, and 30%. Additional embodiments exist wherein the material property of that used for the gun body 140 has a value of elongation ranging from 3% to 30%, any value between, or any range of values between. The deformation of the material can be substantially plastic or substantially elastic. In an example, a substantially plastic deformation occurs when the gun body deforms under pressure, and does not return to the pre-deformed configuration when/if the applied pressure is removed. In contrast, in a substantially elastic deformation, the gun body returns to the pre-deformed configuration, without another externally applied force, after the pressure is removed.

Figure 4:
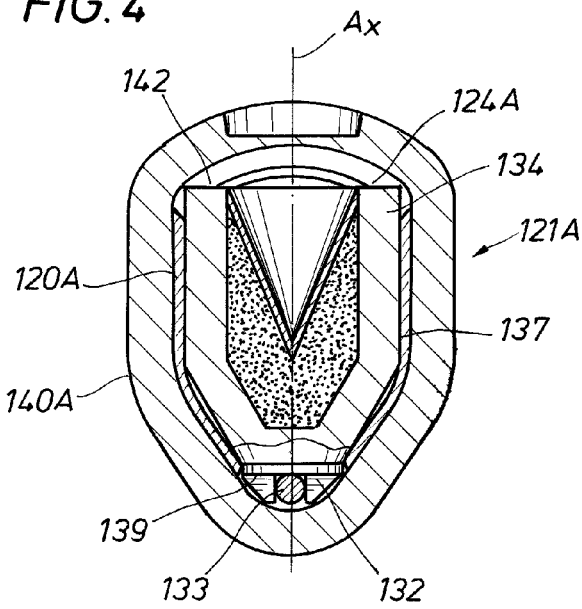
FIG. 4 represents the perforating gun of FIG. 3 under a pressure load.

FIG. 4 illustrates a perforating gun 121A having a deformed gun body 140A shown compressing a deformed gun tube 120A against the outer surface of the shaped charge housing 134. In an example embodiment, disposing the perforating gun 121 of FIG. 3 into a wellbore, or a high pressure wellbore, creates the deformed perforating gun 121A of FIG. 4 having a deformed gun body 140A. Wellbore pressure may produce the deformed perforating gun 121A by exerting a force onto the gun body 140 that exceeds the yield point of the material of the gun body 140.

In an example embodiment, forming the gun body 140 to have a strategically selected diameter to wall thickness ratio so the gun body 140 can conform into the deformed gun body 140A while maintaining sufficient structural integrity to remain intact and continuing to provide a fluid flow barrier between the inside and outside of the gun body 140/140A. In an example embodiment, the shape and configuration of the shaped charge housing 134 remains substantially unchanged by the compressed gun body 140A and gun tube 120A. In another example embodiment, the deformed gun tube 120A is compressed into contact around the shaped charge housing 134. As shown in FIG. 4, the deformed gun tube 120A is in substantial contact on opposing portions of lateral side walls 137 of the shaped charge case 134. Also as shown, the deformed gun tube 120A is in contact along opposing portions of lower lateral side walls 137 shown disposed oblique to an axis $A_X$ of the shaped charge case 134. The cord attachment 132 can resist collapse of the deformed gun tube 120A up against the lower wall 139 of the shaped charge case 134 and thus can prevent crushing of the detonation cord 133. Also as shown in FIG. 4, an annular space 124 is substantially eliminated between the deformed gun body 140A and the deformed gun tube 120A; but may be present between the upper open end 142 of the shaped charge housing 134 and the deformed gun body 140A. Optionally, an embodiment exists where the portion of the gun body 140A above the shaped charge 130A is reconfigured into a substantially planar shape and into contact with the upper open end 142.

Figure 5:
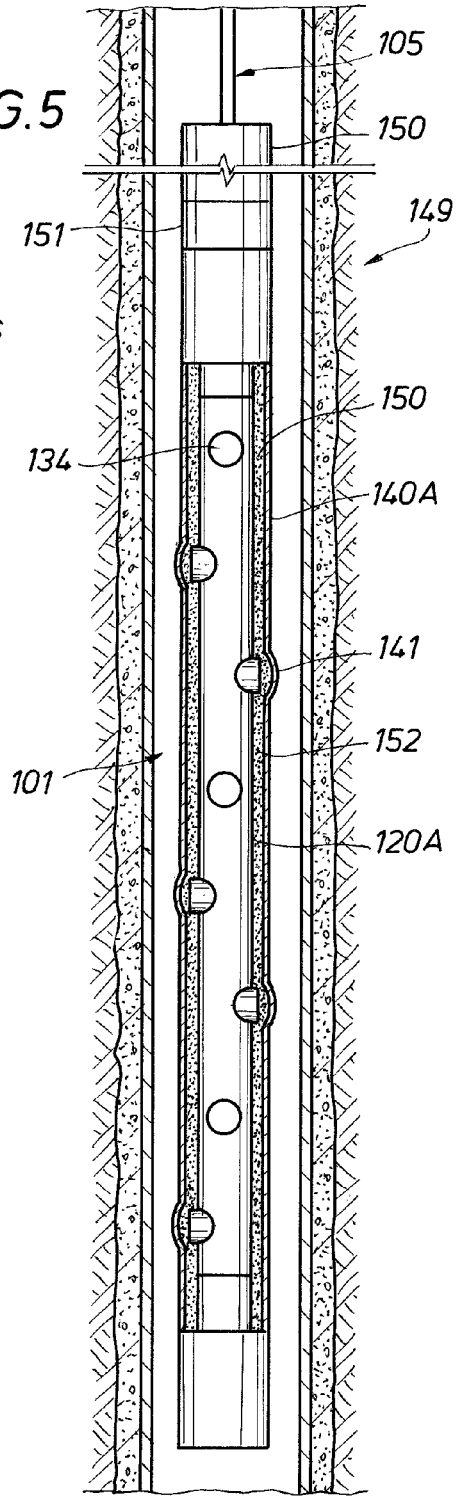
FIG. 5 portrays a side partial sectional view of an alternative embodiment of a perforating gun under pressure loading.

Referring to FIG. 5, an example of a perforating system 149 is illustrated in a side partial sectional view disposed in a wellbore 101. In this example the perforating system 149 includes high pressure perforating guns 150 joined in series with a connector 151 and deployed on a wireline 105. The perforating system 149 may include additional perforating guns or other downhole tools. In this embodiment, the perforating system 149 also includes a flowable material 152, such as sand, or a collection of other particulate matter, is provided in an annulus between the gun body 140A and gun tube 120A. The particles can have a size that are within a narrow particle distribution. Optionally, the particle distribution can be multimodal. In an example embodiment, the flowable material 152 is made up of sand, wherein at least about 95% passes through a No. 4 sieve. In another embodiment, about 10% of the sand is retained on a No. 50 sieve; optionally, not more than 5% passes through a No. 100 sieve. As the gun 150 is deployed into a wellbore, such as in a high pressure zone, the flowable material 152 provides some internal structural support for the deformed gun body 140A. Deformations 141 proximate the individual shaped charges 134 illustrate the shaped charges 134 structurally support the deformed gun body 140A in localized zones adjacent the shaped charges 134. Openings in the shaped charges 134 can be covered by a thin protective layer, such as a tape, to prevent flowable material 152 from entering the shaped charges 134.

An example of a high pressure wellbore or borehole includes a wellbore having a pressure of at least about 15,000 pounds per square inch, at least about 20,000 pounds per square inch, at least about 25,000 pounds per square inch, at least about 30,000 pounds per square inch, at least about 35,000 pounds per square inch, at least about 40,000 pounds per square inch, at least about 45,000 pounds per square inch, and at least about 50,000 pounds per square inch. The pressures listed above can occur at any location or locations in the wellbore.

In an example of operation, the perforating gun 121 depicted in FIG. 3 is lowered into a wellbore 101 and exposed to downhole pressure. The wellbore pressure imparts a force that changes the gun body 140 into the deformed gun body 140A. As noted above, the structure and constituent materials of the undeformed gun body 140 enable deformation to the deformed gun body 140A without experiencing failure, such as the gun body 140/140A buckling, leaking, or rupturing. Additionally, the deformed gun body, although bowed and distorted, will maintain a protective barrier that prevents fluid or other foreign matter from contacting and/or contaminating the shaped charge 130. The shaped charge 130 in the perforating gun 121 can then be detonated to perforate within the wellbore. In an embodiment, multiple shaped charges 130 can be included within a perforating gun 121. Optionally, a perforating string having multiple perforating guns 121 as described herein can be formed, deployed within a high pressure wellbore, and the shaped charges within detonated.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A perforating gun comprising;

a shaped charge comprising a housing with an opening and lateral side walls, a high explosive, and a liner; and a gun tube circumscribing a portion of the shaped charge and that is spaced away from the housing when in an undeformed configuration; and a gun body circumscribing the gun tube, and selectively deformed radially inward so that the gun tube is deformed inward and substantially conforms to an entire exterior wall of the housing.

2. The perforating gun of claim 1, wherein the gun body defines a fluid barrier.

3. The perforating gun of claim 1, wherein the elasticity of the material making up the gun body ranges from about 10% to about 20% elongation.

4. The perforating gun of claim 1, wherein the pressure differential between inside of and ambient to the gun body is at least about 5000 pounds per square inch.

5. The perforating gun of claim 1, wherein the gun body material is selected from the list consisting of aluminum, steel, steel alloy, and nickel alloy.

6. The perforating gun of claim 1, wherein the deformation of the gun body is substantially plastic.

7. The perforating gun of claim 1, further comprising a collection of flowable particles substantially occupying a space between the gun body and the shaped charge.

8. The perforating gun of claim 1, wherein the gun body has an undeformed configuration at an ambient pressure with a space between the lateral side walls and gun tube, and when disposed into a wellbore having a pressure greater than ambient pressure, the gun tube is changeable to a deformed configuration with the gun tube substantially conforming to the exterior wall of the shaped charge.

9. A method of perforating in a wellbore comprising:

providing a perforating gun comprising: a gun body; an annular gun tube inserted within the gun body, a shaped charge in the gun tube;

disposing the perforating gun within a pressurized wellbore, so that the gun body and gun tube deform radially inward from a position spaced radially outward from the shaped charge, and where the gun tube substantially conforms with a sidewall of the shaped charge; and detonating the shaped charge to create a perforation in the wellbore.

10. The method of claim 9, wherein the gun body comprises a material having an elasticity ranging from about 10% to about 20% elongation.

11. The method of claim 9, wherein the gun body comprises a material having a component selected from the list consisting of aluminum and steel.

12. The method of claim 9, wherein the gun body comprises a material having a percent elongation of about 10%.

13. The method of claim 9, further comprising selecting a diameter to wall thickness of the gun body, so that the gun body can deflect radially inward and provide a fluid flow barrier between the inside and outside of the gun body.

* * * * *